United States Patent [19]

Uranishi et al.

[11] Patent Number: 4,834,050

[45] Date of Patent: May 30, 1989

[54] AIR-FUEL RATIO CONTROL DEVICE OF AN INTERNAL COMBUSTION ENGINE

[75] Inventors: Kouji Uranishi, Susono; Takaaki Itou, Mishima, both of Japan

[73] Assignee: Toyota Jidosha Kabushiki Kaisha, Toyota, Japan

[21] Appl. No.: 177,288

[22] Filed: Apr. 1, 1988

[30] Foreign Application Priority Data

Apr. 6, 1987 [JP] Japan ..... 62-83095

[51] Int. Cl.[4] ..... F02D 41/22; F02M 7/24; F02M 25/08

[52] U.S. Cl. ..... 123/440; 123/489; 123/520; 123/589

[58] Field of Search ..... 123/440, 489, 519, 520, 123/589, 439

[56] References Cited

U.S. PATENT DOCUMENTS 4,633,840 1/1987 Saito et al. ..... 123/489
4,641,623 2/1987 Hamburg ..... 123/440 X
4,763,634 8/1988 Morozumi ..... 123/520

FOREIGN PATENT DOCUMENTS 1857 1/1986 Japan ..... 123/520

*Primary Examiner*—Tony M. Argenbright
*Attorney, Agent, or Firm*—Cushman, Darby & Cushman

[57] ABSTRACT

An air-fuel ratio control device comprising an electric air bleed control valve which controls the amount of air fed into the fuel passage of the carburetor so that an air-fuel ratio becomes equal to the stoichiometric air-fuel ratio. The degree of opening of the air bleed control valve is increased as an electric current fed into the air bleed control valve is increased. Fuel vapor is fed into the intake passage from the canister. An auxiliary air is also fed into the intake passage via an electric auxiliary air bleed control valve. When the supply of fuel vapor to the intake passage is started, if the electric current fed into the air bleed control valve increases and reaches the upper limit, the auxiliary air bleed control valve is opened. As a result, the electric current fed into the air bleed control valve is lowered and can move up and down so that an air-fuel ratio becomes equal to the stoichiometric air-fuel ratio.

13 Claims, 8 Drawing Sheets

AIR-FUEL RATIO CONTROL DEVICE OF AN INTERNAL COMBUSTION ENGINE

BACKGROUND OF THE INVENTION

1. Field of the Invention

The present invention relates to an air-fuel ratio control device of an internal combustion engine.

2. Description of the Related Art

A known internal combustion engine comprises an electric purge control valve for controlling the supply of purge gas fed into the intake passage of an engine from a charcoal canister, and an electric air bleed control valve for controlling the amount of air fed into the fuel passage of a carburetor. An electric current fed into the air bleed control valve is controlled on the basis of the output signal of an oxygen concentration detecting sensor (hereinafter referred to as an $O_2$ sensor) arranged in the exhaust passage of the engine so that the amount of air fed into the fuel passage of the carburetor is increased as the amount of electric current fed into the air bleed control valve is increased (Japanese Unexamined Patent Publication No. 61-1857). In this engine, when the purge control valve is opened, and thus the supply of the purge gas is started, if the purge gas contains a large fuel component, an air-fuel mixture fed into the engine cylinders becomes extremely rich. As a result, the amount of electric current fed into the air bleed control valve is increased so that an air-fuel ratio approaches the stoichiometric air-fuel ratio, and accordingly, the amount of air fed into the fuel passage of the carburetor is increased.

However, there is a limitation to the possible range of air-fuel ratio which can be controlled by changing the amount of air fed into the fuel passage of the carburetor, and thus a problem arises in that, when the air-fuel mixture becomes extremely rich due to the supply of purge gas, even if the amount of electric current fed into the air bleed control valve is increased to the maximum level of the controllable range, the air-fuel mixture is still in a rich state. To solve this problem, in this engine, when the amount of electric current fed into the air bleed control valve is increased to the maximum level of the controllable range, an air-fuel ratio control is changed from the air-fuel ratio control based on the air bleed control to the air-fuel ratio control based on the purge control, and thus the amount of purge gas is controlled so that an air-fuel ratio approaches the stoichiometric air-fuel ratio.

Note, fuel vapor produced, for example, in the fuel tank, is fed into the charcoal chanister, and the fuel component of the fuel vapor is adsorbed in the activated carbon of the canister. In this case, as time elapses after the adsorption, the fuel component penetrates deeper into the activated carbon and is firmly retained therein. However, there is a limitation to the amount of fuel component which can be adsorbed in the activated carbon, and thus if the fuel component is retained in the activated carbon, the amount of fuel component which can be newly adsorbed in the activated carbon is reduced by the amount of fuel component already retained in the activated carbon. That is, if the activated carbon with the fuel vapor adsorbed therein is not disturbed for a long time, the adsorbing ability of the activated carbon is gradually reduced. Consequently, to prevent a reduction of the adsorbing ability of the activated carbon, as much as possible of the fuel component adsorbed in the activated carbon must be desorped, so that the fuel component is not retained deep in the activated carbon.

However, where the amount of purge gas is controlled as in the above-mentioned engine, since the amount of purge gas fed into the intake passage of the engine is reduced, the amount of fuel component which is retained in the activated carbon is increased, and as a result, since the amount of fuel component penetrating deep into the activated carbon and retained therein is increased, a problem arises in that the adsorbing ability of the activated carbon is reduced.

SUMMARY OF THE INVENTION

An object of the present invention is to provide an air-fuel ratio control device capable of controlling an air-fuel ratio so that this ratio approaches a predetermined air-fuel ratio even when the purge gas is fed into the intake passage of the engine while preventing a reduction of the adsorbing ability of the activated carbon.

According to the present invention, there is provided an internal combustion engine having at least one cylinder, an intake passage and an exhaust passage, said engine comprising: a carburetor arranged in the intake passage and having a fuel passage which is open to the intake passage; an electric air-fuel ratio control valve arranged controlling an air-fuel ratio of an air-fuel mixture fed into the cylinder in response to an electric control signal, the air-fuel ratio of the air-fuel mixture being increased as a level of the electric control signal is raised; an oxygen concentration detector arranged in the exhaust passage to produce a lean signal when the air-fuel ratio of the air-fuel mixture fed into the cylinder is larger than a predetermined air-fuel ratio and to produce a rich signal when the air-fuel ratio of the air-fuel mixture is smaller than the predetermined air-fuel ratio; first control means controlling the level of the electric control signal in response to the lean signal and the rich signal to raise the level of the electric control signal when the rich signal is produced and to lower the level of the electric control signal when the lean signal is produced; a charcoal canister containing activated carbon; a fuel vapor passage connecting the charcoal canister to the intake passage; second control means for increasing the air-fuel ratio of air-fuel mixture; and third control means actuating the second control means in response to the level of the electric control signal to increase the air-fuel ratio of the air-fuel mixture after the level of the electric control signal is raised and reaches a predetermined upper level.

The present invention may be more fully understood from the description of preferred embodiments of the invention set forth below, together with the accompanying drawings.

DESCRIPTION OF THE PREFERRED EMBODIMENTS

Figure 1:
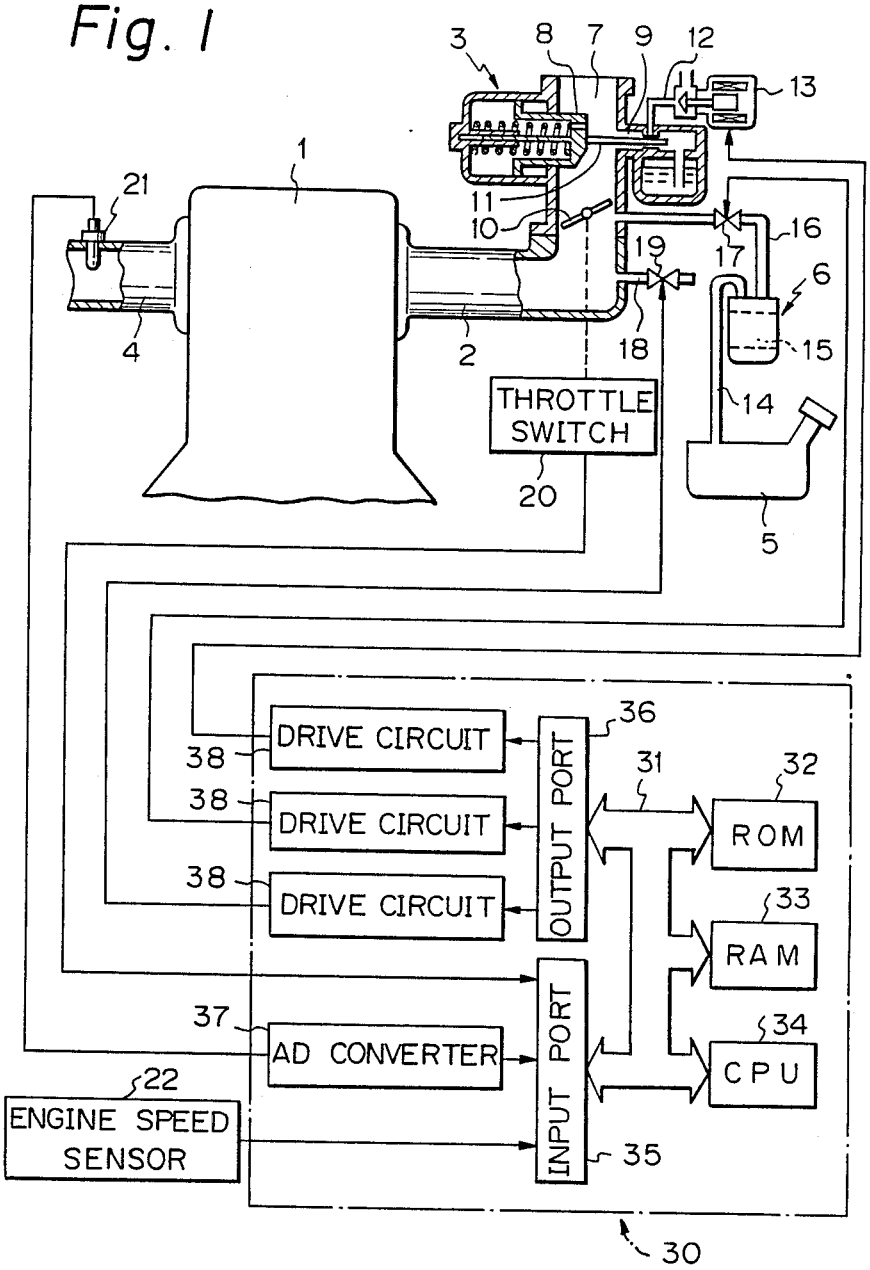
FIG. 1 is a schematically illustrated view of an engine.

Referring to FIG. 1, reference numeral 1 designates an engine body, 2 an intake manifold, 3 a variable venturi type carburetor, and 4 an exhaust manifold; 5 designates a fuel tank, and 6 a charcoal canister containing activated carbon. The variable venturi type carburetor 3 comprises an intake passage 7, a suction piston 8, a fuel passage 9 which is open to the intake passage 7, and a throttle valve 10. The amount of fuel fed into the intake passage 7 from the fuel passage 9 is controlled by a needle 11 mounted on the suction piston 8. An air bleed passage 12 is connected to the fuel passage 9, and an air bleed control valve 13 is arranged in the air bleed passage 12. This air bleed control valve 13 is controlled on the basis of a control electric current output from an electronic control unit 30. When the control electric current fed into the air bleed control valve 13 is increased, the amount of air fed into the fuel passage 9 from the air bleed passage 12 is increased, and thus the air-fuel mixture fed into the engine cylinders becomes lean. Conversely, when the control electric current fed into the air bleed control valve 13 is reduced, the amount of air fed into the fuel passage 9 from the air bleed passage 12 is reduced, and thus the air-fuel mixture fed into the engine cylinders becomes rich.

The fuel tank 5 is connected to the charcoal canister 6 via a fuel vapor conduit 14, and fuel vapor produced in the fuel tank 5 is adsorbed by the activated carbon 15 in the canister 6. In addition, the canister 6 is connected via a purge conduit 16 to the intake passage 7 downstream of the throttle valve 10, and a purge control valve 17 is arranged in the purge conduit 16. When the purge control valve 17 is opened, fuel adsorbed in the activated carbon 15 is desorped therefrom, and thus fuel vapor is fed into the intake passage 7 from the purge conduit 16. An auxiliary air bleed passage 18 is connected to the interior of the intake manifold 2 downstream of the throttle valve 10, and an auxiliary air bleed control valve 19 is arranged in the auxiliary air bleed passage 18.

The electronic control unit 30 is constructed as a digital computer and comprises a ROM (read only memory) 32, a RAM (random access memory) 33, a CPU (microprocessor, etc.) 34, an input port 35 and an output port 36. The ROM 32, the RAM 33, the CPU 34, the input port 35 and the output port 36 are interconnected via a bidirectional bus 31. A throttle switch 20 for detecting the idling opening degree of the throttle valve 10 is attached to the throttle valve 10, and the output signal of the throttle switch 20 is input to the input port 35. An $O_2$ sensor 21 is arranged in the exhaust manifold 4, and the output signal of the $O_2$ sensor 21 is input to the input port 35 via an AD converter 37. In addition, an engine speed sensor 22 producing output pulses having a frequency proportional to the engine speed is connected to the input port 35. The output port 36 is connected to the air bleed control valve 13, the purge control valve 17, and the auxiliary air bleed control valve 19 via corresponding drive circuits 38.

An air-fuel ratio control according to the present invention will be hereinafter described with reference to FIGS. 2 through 5.

Figure 4:
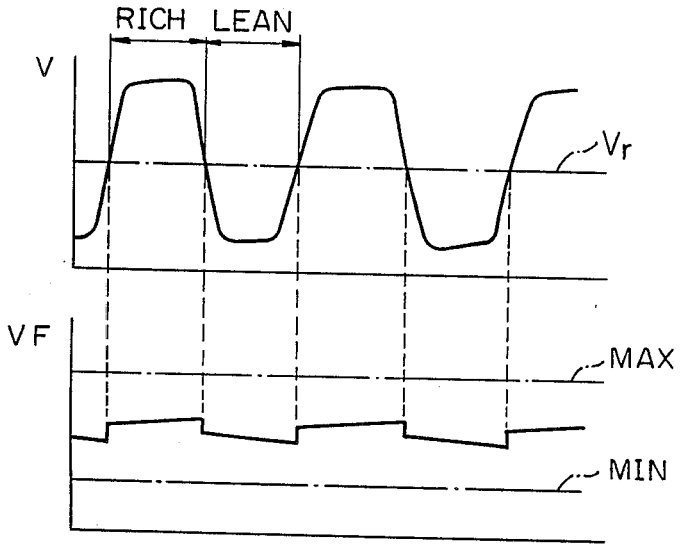
FIG. 4 is a diagram illustrating the output signal of the $O_2$ sensor and the control electric current VF.

FIG. 4 illustrates changes in the output voltage V of the $O_2$ sensor 21. The $O_2$ sensor 21 produces an output voltage V of about 0.9 volt when the air-fuel mixture is rich, and produces an output voltage V of about 0.1 volt when the air-fuel mixture is lean. The output voltage V of the $O_2$ sensor 21 is compared with a reference voltage Vr of about 0.45 volt, by the CPU 34. At this time, if the output voltage V of the $O_2$ sensor 21 is higher than Vr, the air-fuel mixture is considered rich, and if the output voltage V of the $O_2$ sensor 21 is lower than Vr, the air-fuel mixture is considered lean.

Figure 2:
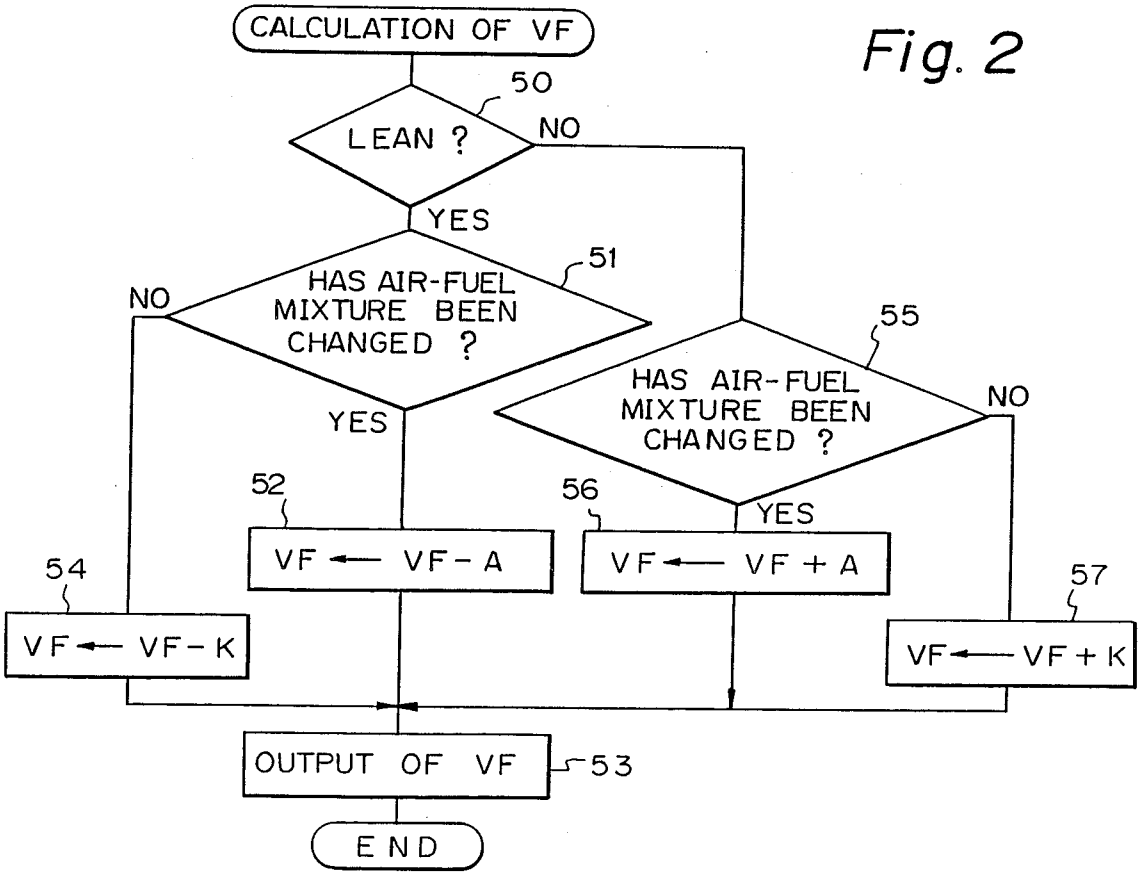
FIG. 2 is a flow chart for executing the calculation of the control electric current VF.

FIG. 2 illustrates a routine for the calculation of the control electric current VF of the air bleed control valve 13, which calculation is carried out on the basis of a determination of whether the air-fuel mixture is rich or lean.

Referring to FIG. 2, in step 50, it is determined whether or not the air-fuel mixture is lean. When the air-fuel mixture is lean, the routine goes to step 51, and it is determined whether or not the air-fuel mixture has been changed from rich to lean after completion of the preceding processing cycle. When the air-fuel mixture has been changed from rich to lean, the routine goes to step 52, and a skip value A is subtracted from VF. Then, the routine goes to step 53. When the air-fuel mixture has not been changed from rich to lean after completion of the preceding processing cycle, the routine goes to step 54, and an integration value K ($K << A$) is subtracted from VF. Then, the routine goes to step 53.

When it is determined in step 50 that the air-fuel mixture is rich, the routine goes to step 55, and it is determined whether or not the air-fuel mixture has been changed from lean to rich after completion of the preceding processing cycle. When the air-fuel mixture has been changed from lean to rich, the routine goes to step 56, and the skip value A is added to VF. Then, the routine goes to step 53. When the air-fuel mixture has not been changed from lean to rich after completion of the preceding processing cycle, the routine goes to step 57, and the integration value K is added to VF. Then, the routine goes to step 53. In step 53, VF is output to the output port 36.

Consequently, as illustrated in FIG. 4, when the air-fuel mixture is changed from rich to lean, the value of VF is abruptly reduced by the skip value A and then gradually further reduced. Conversely, when the air-fuel mixture is changed from lean to rich, the value of VF is abruptly increased by the skip value A and then gradually further increased. The value of VF calculated in each of steps 52, 54, 56, 57 and output to the output port 36 in step 53 in FIG. 2 represents a pulse duty cycle, and a series of pulses, which are produced at a fixed frequency and have a pulse width which is changed in accordance with the duty cycle, are fed into the air bleed control valve 13. The degree of opening of the air bleed control valve 13 is controlled in response to the mean value of the electric current of the series of pulses and, therefore, VF is used as the control electric current of the air bleed control valve 13. The range of the control current VF which is able to control an air-fuel ratio is between the minimum value MIN and the maximum value MAX in FIG. 4, and the control current VF normally moves up and down between MIN and MAX while the feedback control is carried out.

Figure 5:
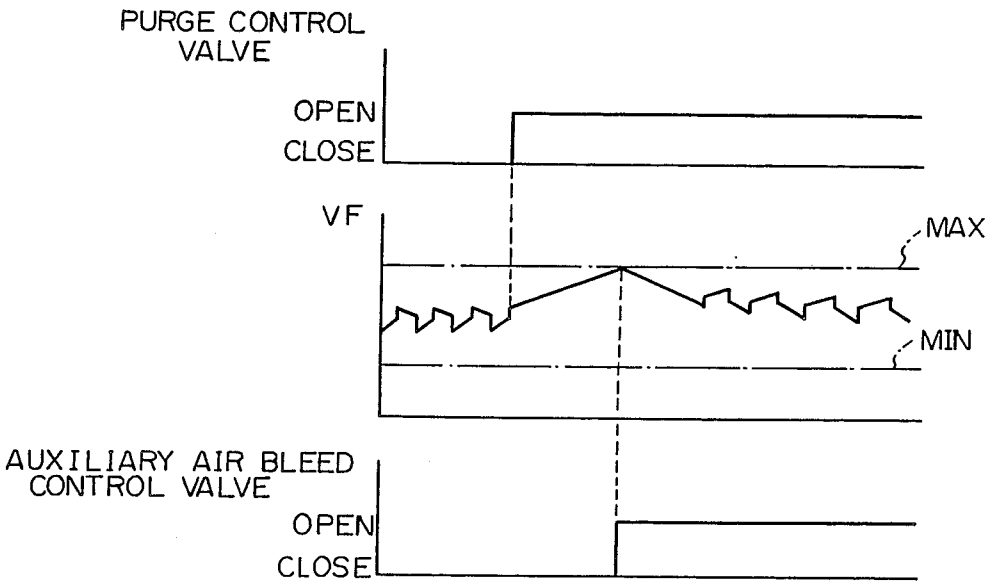
FIG. 5 is a diagram illustrating the control electric current VF and the opening operation of both the purge control valve and the auxiliary air bleed control valve.

That is, as illustrated in FIG. 5, when the purge control valve 17 is closed, and thus the supply of the purge gas to the intake passage 7 is stopped, the electric control current VF moves up and down between MIN and MAX. Then, if the purge control valve 17 is opened, and thus the purge gas containing a large fuel component is fed into the intake passage 7, since the air-fuel mixture fed into the engine cylinders becomes excessively rich, the control electric current VF is increased and reaches the upper limit MAX as illustrated in FIG. 5. When the control current VF reaches the upper limit MAX, the auxiliary air bleed control valve 19 is opened as illustrated in FIG. 5, and thus an auxiliary air is fed into the intake passage 7 from the auxiliary air bleed passage 18. When the supply of the auxiliary air is started, since the air-fuel mixture becomes lean, the control electric current VF is reduced, and then the control electric current VF again moves up and down between MIN and MAX to make the air-fuel ratio equal to the stoichiometric air-fuel ratio. The amount of purge gas fed into the intake passage 7 is proportional to the level of vacuum in the intake passage 7, and the amount of auxiliary air fed into the intake passage 7 is also proportional to the level of vacuum in the intake passage 7. Consequently, by suitably determining the flow area of the auxiliary air bleed control valve 19, which is formed when the auxiliary air bleed control valve 19 is open, when the supply of purge gas is carried out, it is possible to cause the control electric current VF to move up and down between MIN and MAX regardless of the level of vacuum in the intake passage 7. Therefore, even when the supply of purge gas is carried out, it is possible to control the air-fuel ratio so that it becomes equal to the stoichiometric air-fuel ratio.

Figure 3:
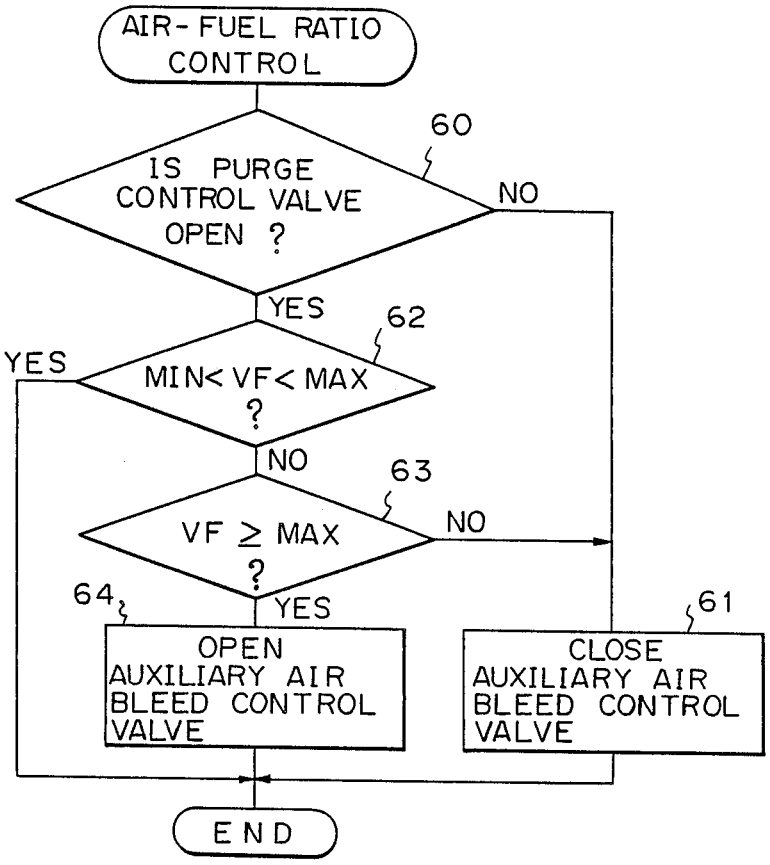
FIG. 3 is a flow chart for executing the control of an air-fuel ratio.

FIG. 3 illustrates a flow chart for executing the control illustrated in FIG. 5.

Referring to FIG. 3, in step 60, it is determined whether or not the purge control valve 17 is open. This purge control valve 17 is closed, for example, when the engine is operating in an idling state, and the purge control valve 17 is open when the throttle valve 10 is open. When the purge control valve 17 is closed, the routine goes to step 61, and the auxiliary air bleed control valve 19 is closed. Conversely, when the purge control valve 17 is open, the routine goes to step 62, and it is determined whether the control electric current VF is between MIN and MAX. Even if the purge control valve 17 is open, when the control electric current VF is between MIN and MAX, the processing cycle is completed. Conversely, when the purge control valve 17 is open, if the control electric current VF becomes lower than MIN or higher than MAX, the routine goes to step 63, and it is determined whether the control current VF is equal to or larger than MAX. If VF<MAX, the routine goes to step 61, and the auxiliary air bleed control valve 19 remains closed. Conversely, if VF≧MAX, the routine goes to step 64, and the auxiliary air bleed control valve 19 is opened. When the control electric current VF becomes a value between MIN and MAX by opening the auxiliary air bleed control valve 19, the successive processing cycle is completed via step 62, and thus the auxiliary air bleed control valve 19 remains open.

Figure 6:
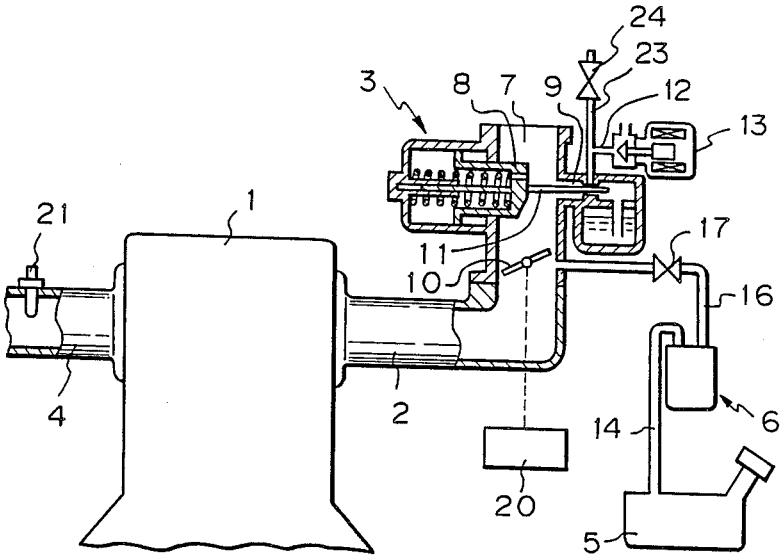
FIG. 6 is a schematically illustrated view of another embodiment of an engine.

FIG. 6 illustrates another embodiment. In this embodiment, an auxiliary air bleed passage 23 is connected to the air bleed passage 12, and an auxiliary air bleed control valve 24 is arranged in the auxiliary air bleed passage 23. In this embodiment, when the control electric current VF becomes MAX after the purge control valve 17 is opened, the auxiliary air bleed control valve 24 is opened.

Figure 7:
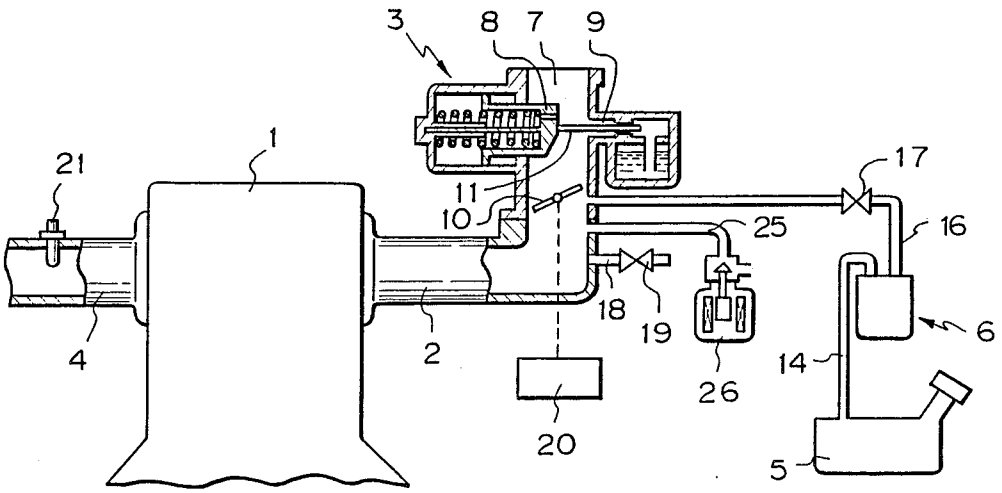
FIG. 7 is a schematically illustrated view of a further embodiment of an engine.

FIG. 7 illustrates a further embodiment of the present invention. In this embodiment, an air supply passage 25 is connected to the intake passage 7 downstream of the throttle valve 10, and an air control valve 26 is arranged in the air supply passage 25. This air control valve 26 is controlled on the basis of a control electric current output from the electronic control unit 30 (FIG. 1). When the control electric current fed into the air control valve 26 is increased, the amount of air fed into the intake passage 7 from the air supply passage 25 is increased, and thus the air-fuel mixture fed into the engine cylinders becomes lean. Conversely, when the control electric current fed into the air control valve 26 is reduced, the amount of air fed into the intake passage 7 from the air supply passage 25 is reduced, and thus the air-fuel mixture fed into the engine cylinders becomes rich.

In this embodiment, the electric control current VF of the air control valve 26 is controlled on the basis of the routine illustrated in FIG. 2. Consequently, as illustrated in FIG. 4, when the air-fuel mixture is changed from rich to lean, the value of VF is abruptly reduced by the skip value A and then gradually further reduced. Conversely, when the air-fuel mixture is changed from lean to rich, the value of VF is abruptly increased by the skip value A and then gradually further increased. Also in this embodiment, the range of the control current VF which is able to control an air-fuel ratio is between the minimum value MIN and the maximum value MAX in FIG. 4, and the control current VF normally moves up and down between MIN and MAX while the feedback control is carried out.

Further, in this embodiment, when the purge control valve 17 is closed, and thus the supply of the purge gas to the intake passage 7 is stopped, the electric control current VF moves up and down between MIN and MAX. Then, if the purge control valve 17 is opened, and thus the purge gas containing a large fuel component is fed into the intake passage 7, since the air-fuel mixture fed into the engine cylinders becomes excessively rich, the control electric current VF is increased and reaches the upper limit MAX. When the control current VF reaches the upper limit MAX, the auxiliary air bleed control valve 9 is opened, and thus an auxiliary air is fed into the intake passage 7 from the auxiliary air bleed passage 18. When the supply of the auxiliary air is started, since the air-fuel mixture becomes lean, the control electric current VF is reduced, and then the control electric current VF again moves up and down between MIN and MAX to make the air-fuel ratio equal to the stoichiometric air-fuel ratio.

Figure 8:
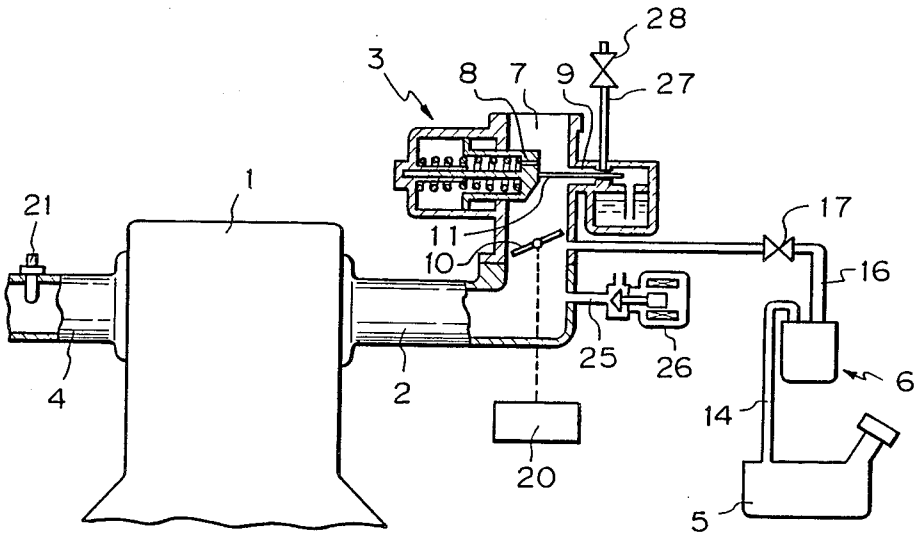
FIG. 8 is a schematically illustrated view of a still further embodiment of an engine.

FIG. 8 illustrates an alternative embodiment of the engine illustrated in FIG. 7. In this embodiment, an auxiliary air supply passage 27 is connected to the fuel passage 9, and an auxiliary air control valve 28 is arranged in the auxiliary air supply passage 27. In this embodiment, when the control electric current VF becomes MAX after the purge control valve 17 is opened, the auxiliary air control valve 28 is opened.

According to the present invention, even when the fuel vapor is purged into the intake passage, it is possible to control an air-fuel ratio so that it becomes equal to the stoichiometric air-fuel ratio. In addition, since the amount of purge gas fed into the intake passage is not controlled, it is possible to desorb the entire fuel component adsorbed by the activated carbon in the canister, and thus makes it possible to prevent a deterioration of the condition of the activated carbon.

While the invention has been described by reference to specific embodiments chosen for purposes of illustration, it should be apparent that numerous modifications could be made thereto by those skilled in the art without departing from the basic concept and scope of the invention.

We claim:

1. An internal combustion engine having at least one cylinder, an intake passage and an exhaust passage, said engine comprising:

a carburetor arranged in the intake passage and having a fuel passage which is open to the intake passage;

an electric air-fuel ratio control valve controlling an air-fuel ratio of an air-fuel mixture fed into the cylinder in response to an electric control signal, said air-fuel ratio of the air-fuel mixture increasing as a level of said electric control signal rises;

an oxygen concentration detector arranged in the exhaust passage to produce a lean signal when said air-fuel ratio of the air-fuel mixture fed into the cylinder is larger than a predetermined air-fuel ratio and to produce a rich signal when said air-fuel ratio of the air-fuel mixture is smaller than the predetermined air-fuel ratio;

first control means controlling the level of said electric control signal in response to said lean signal and said rich signal to raise the level of said electric control signal when said rich signal is produced and lower the level of said electric control signal when said lean signal is produced;

a charcoal canister containing activated carbon therein;

a fuel vapor passage connecting said charcoal canister to the intake passage;

second control means for increasing said air-fuel ratio of air-fuel mixture; and third control means actuating said second control means in response to the level of said electric control signal to increase said air-fuel ratio of the air-fuel mixture after the level of said electric control signal is raised and reaches a predetermined upper level.

2. An internal combustion engine according to claim 1, wherein said electric control signal is represented by an electric current.

3. An internal combustion engine according to claim 1, wherein said predetermined air-fuel ratio is the stoichiometric air-fuel ratio.

4. An internal combustion engine according to claim 1, wherein said fuel vapor passage has a purge control valve therein, and said third control means actuates said second control means to increase said air-fuel ratio of air-fuel mixture when said purge control valve is open.

5. An internal combustion engine according to claim 4, wherein said third control means stops the increasing operation of said air-fuel ratio of air-fuel mixture when said purge control valve is closed.

6. An internal combustion engine according to claim 5, wherein the level of said electric control signal normally varies between said predetermined upper level and a predetermined lower level which is lower than said upper level when said purge control valve is in a closed position.

7. An internal combustion engine according to claim 4, wherein said purge control valve is closed when the engine is operating in an idling state.

8. An internal combustion engine according to claim 1, wherein said carburetor has an air bleed passage connected to said fuel passage, and said electric air-fuel ratio control valve is arranged in said air bleed passage to control the amount of air fed into said fuel passage from said air bleed passage in response to said electric control signal, said amount of air increasing as the level of said electric control signal rises.

9. An internal combustion engine according to claim 1, further comprising a throttle valve arranged in the intake passage, and an air supply passage open to the intake passage downstream of said throttle valve, wherein said electric air-fuel ratio control valve is arranged in said air supply passage to control the amount of air fed into the intake passage from said air supply passage in response to said electric control signal, said amount of air increasing as the level of said electric control signal rises.

10. An internal combustion engine according to claim 1, wherein said second control means comprises an auxiliary air passage connected to the intake passage, and an auxiliary air control valve arranged in said auxiliary air passage and being opened after the level of said electric control signal reaches the predetermined upper level.

11. An internal combustion engine according to claim 10, further comprising a throttle valve arranged in the intake passage, both said fuel vapor passage and said auxiliary air passage being connected to the intake passage downstream of said throttle valve.

12. An internal combustion engine according to claim 1, wherein said second control means comprises an auxiliary air passage connected to said fuel passage, and an auxiliary air control valve arranged in said auxiliary air passage and being opened after the level of said electric control signal reaches the predetermined upper level.

13. An internal combustion engine according to claim 12, wherein said carburetor has an air bleed passage connected to said fuel passage, and said electric air-fuel ratio control valve is arranged in said air bleed passage to control the amount of air fed into said fuel passage from said air bleed passage in response to said electric control signal, said amount of air increasing as the level of said electric control signal rises, said auxiliary air passage being connected to said air bleed passage.

* * * * *